US005210930A

United States Patent [19]

Watabe et al.

[11] Patent Number: 5,210,930

[45] Date of Patent: May 18, 1993

[54] METHOD OF MANUFACTURING WOUND CORE

[75] Inventors: Tadatoshi Watabe, Tokyo; Shoichi Miyasaka, Chino, both of Japan

[73] Assignee: Denki Tetsushin Industries Co., Ltd., Tokyo, Japan

[21] Appl. No.: 793,986

[22] Filed: Nov. 18, 1991

[30] Foreign Application Priority Data

Aug. 5, 1991 [JP] Japan ..... 3-284249

[51] Int. Cl.[5] ..... H01F 41/02

[52] U.S. Cl. ..... 29/609; 336/213; 336/234

[58] Field of Search ..... 29/609, 605, 606; 336/213, 234

[56] References Cited

U.S. PATENT DOCUMENTS 4,557,039 12/1985 Manderson ..... 29/609 X

FOREIGN PATENT DOCUMENTS 44-24605 10/1969 Japan .
60-28375 7/1985 Japan .
61-22851 6/1986 Japan .
2-113509 4/1990 Japan .

*Primary Examiner*—Carl E. Hall
*Attorney, Agent, or Firm*—Nikaido, Marmelstein, Murray & Oram

[57] ABSTRACT

A method of manufacturing a wound core formed by winding a long, narrow strip of magnetic material, used for transformers reactors or other devices. One belt shaped magnetic material is cut along one polygonal line that extends in the longitudinal direction of the strip of material so as to form two continuous strips each of which consists of a sequential connection of individual portions of winding material, each of which portion has a shape of a long, narrow pentagon wherein the width changes to be narrow at a leading end thereof, wide in the middle part and narrow again at the trailing end. One side edge of each continuous strip forms a straight line and the other edge forms a polygonal line. One of the portions of winding material is wound, while maintaining the center of the strip at a fixed position in the width direction, to form a wound core with a hexagonal cross-section. As result, there is no waste of material and connection of separate strips of material during the winding is unnecessary.

7 Claims, 5 Drawing Sheets

METHOD OF MANUFACTURING WOUND CORE

BACKGROUND OF THE INVENTION

The present invention relates to a method of manufacturing a core to be used for a transformer or a reactor, for example, and, in particular, to a wound core formed by winding a long, narrow shaped strip of magnetic material.

Conventionally, for a transformer of low- or medium power of about 5–200 KVA, a wound core 1 having a stepped-circular shape in cross-section, as shown in FIGS. 6 and 7, is used. The wound core 1 is manufactured by winding three kinds of belt shaped material, each of different width. That is, a first material of narrow width is wound around a bobbin (not shown in the FIGS.) to form a portion 2*a*, and the winding operation is discontinued in order to connect a second material of medium width to the first wound material. Then the winding is resumed to form portion 2*b*, and the winding is discontinued again in order to connect a third material of broad width. Then the winding is resumed to form portion 2*c*. Thereafter, portion 2*d* is formed with the material of medium width and portion 2*e* with the material of narrow width in the same manner, respectively. Then the wound core is completed after removing the bobbin.

A dividable cylindrical bobbin is fitted around the leg portion of the wound core which has a stepped-circular shape in cross-section and, while the bobbin is rotating, wires are wound around the bobbin. The wound core is made into a transformer or other device.

In the wound core having a stepped-circular shape in cross-section, such steps are provided to increase the occupation ratio of the cross-section of the magnetic material in the wire wound circularly and at the same time enabling the core to cool itself by conducting a flow of air or oil through spaces formed by the steps. The occupation ratio of the cross-section is about 85% for a core with five steps as shown in the Figure. The more steps provided, the larger the occupation ratio that may be achieved. If a form having three steps, which is simpler, is provided, the occupation ratio is about 79%. In practical embodiments of a transformer, a wound core having three to nine steps may be used.

In addition to the wound core with steps as described above, a cut-core 3 with steps as shown in FIGS. 8 and 9 is available. In the cut-core with steps, the wound core is cut and separated after being formed, a coil 4 is put in, and the separated parts are joined to each other for use. The shape of the cross-section of the cut-core may be a square because the coil is put into the core. The corner portions of the square, however, are removed to form a cross-section shape with three steps due to a restriction to the bending radius of the coil wire.

In manufacturing either the aforementioned wound core having a stepped-circular shape in ross section or a cut-core with steps it is necessary to interrupt the winding operation and to connect a new strip of material each time it is required to change the width of the material. The efficiency of the operation is therefore reduced and completed products have problems such that the magnetic reluctance increases and noises are caused due to movements between the connecting portions. Further, it is complicted to control the materials because a number of different materials are used.

Alternatively a wound core with a circular cross-section is commonly used (Japanese patent publication No. 60-28357, Japanese patent publication No. 61-22851). To make such a wound core, a material is cut out so that the width changes gradually and the edge forms an elliptical curve, and then the cut material is wound.

Although a high occupation ratio of the cross-section can be obtained with the wound core with a circular cross-section, there is a waste of material and economical efficiency is therefore reduced because the side edge of the material supplied in the form of a belt shape of equal width is cut out into a curved form for use. Furthermore, the process of scrapping and cutting takes considerable effort. Thus, a wound core of this kind is normally used only for light electric devices of relatively small capacity and is not used for power instruments.

Furthermore, a wound core with a polygonal cross-section is known (Japanese patent publication No. 44-24605). This wound core is manufactured in the following manner. A belt shaped material is temporarily wound, and then shifted sideways to form the side end into a circular cone. It is then cut out in a plane and rewound to form a winding material in a shape of long narrow trapezoid. Several kinds of the winding materials are wound to a bobbin being connected to each other to form a wound core having a polygonal shaped cross-section.

The wound core with a polygonal cross-section has the advantage that the material waste is reduced, but because it has connected portions, there are potential problems in practical application as in the case of the aforementioned wound core with a stepped-circular cross-section. Further, the cutting of the material is troublesome as well as difficult. Therefore, the wound core of this kind has not been put to practical use.

SUMMARY OF THE INVENTION

The object of the present invention is to provide an improved method of manufacturing a wound core which solves the inconveniences of each of the aforementioned wound cores without causing waste of material, as well as enabling highly efficient manufacturing while substantially improving the characteristics of the applied transformer.

The present invention relates to the method of manufacturing a wound core comprising the steps of: cutting one belt shaped strip magnetic material along one polygonal line that extends in the longitudinal direction forming two continuous strips of material, each of which consists of a sequential connection of individual strips of winding material, each of which has a shape of a long, narrow pentagon wherein the width changes to be narrow at the leading end thereof and wide in the middle part and narrow again at the trailing end, and one side edge thereof forms a straight line and the other edge forms a poligonal line; and winding one of said winding materials maintaining the center thereof at a fixed position in the width direction to form a wound core with a hexagonal cross section.

DETAILED DESCRIPTION OF PREFERRED EMBODIMENTS

The present invention will be specifically described hereinafter with reference to the figures.

Figure 1:
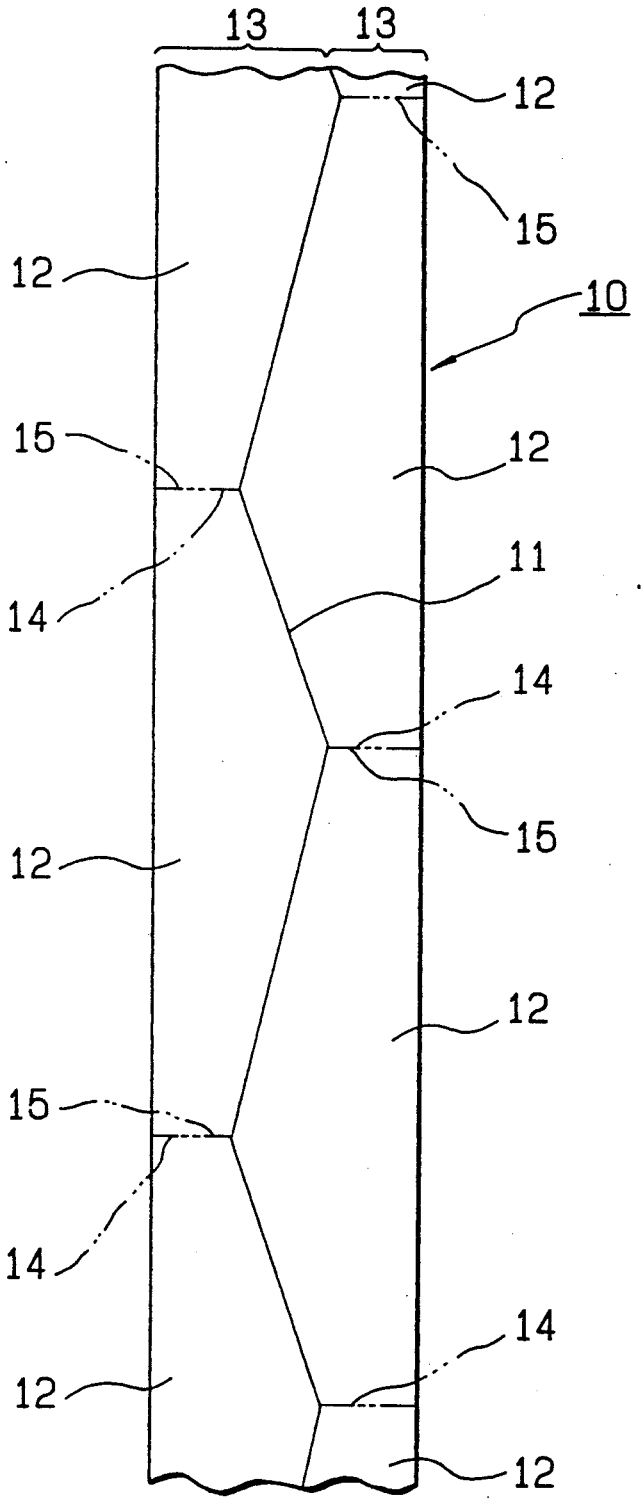
FIG. 1 is a plan view showing a method of cutting out a material according to the present invention, wherein the scale for the longitudinal direction is reduced to one several-hundredths of that for the width direction.
Figure 2:
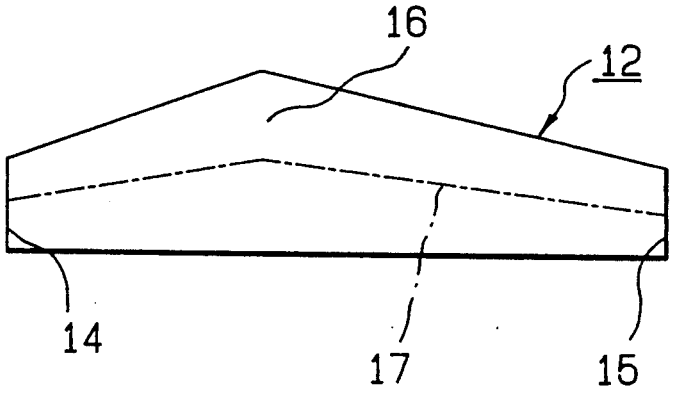
FIG. 2 is a plan view showing one strip of winding material of the present invention, wherein the scale for the longitudinal direction is reduced to one several-hundredths of that for the width direction.

First, as shown in FIG. 1, a belt shaped magnetic material 10 is cut along one polygonal line 11 that extends in its longitudinal direction. For the convenience of illustration, FIG. 1 and FIG. 2 represent the length wherein the scale for the longitudinal direction is reduced to one several-hundredths of that for the width direction. In this way, in each side of the polygonal line 11, there is provided a continuous strip of material 13 which consisits of a sequential connection of shorter strips of winding materials 12 as shown in FIG. 2, each of which strip has a shape of long, narrow pentagon wherein the width changes to be narrow at the leading end thereof and wide in the middle part and narrow again at the trailing end, and one side edge thereof forms a straight line and the other edge forms a poligonal line. In this embodiment, as a finished wound core is to have an equilateral hexagonal shape in cross-section, the leading end 14 and the trailing end 15 of a winding material 12 have the the same width, and the width of the widest portion 16 in the middle part is twice as wide as that of the leading end 14 or the trailing end 15. Moreover, the length from the leading end 14 to the widest portion 16 is smaller than that from the widest position 16 to the trailing end 15, so that the widest portion 16 is located at the center of the thickness of the cross-section of the wound core when the material is wound to a bobbin with the leading end 14 positioning inside.

Figure 3:
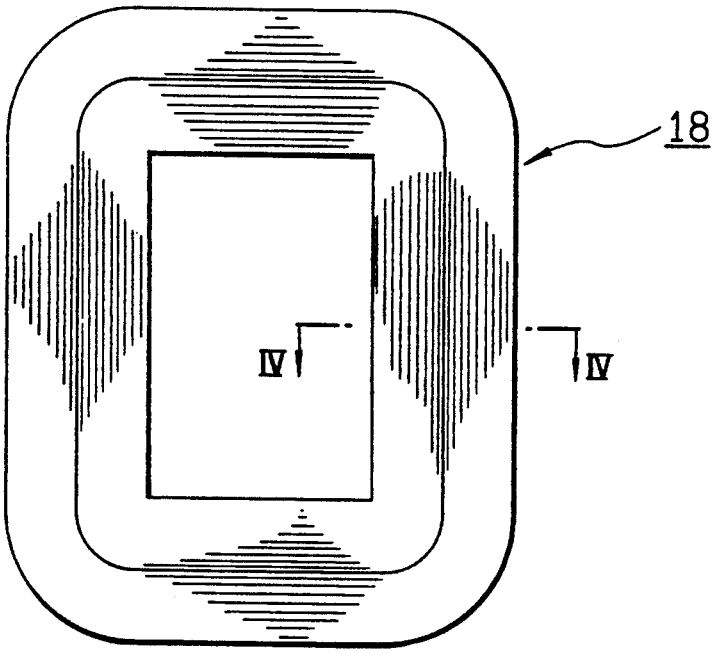
FIG. 3 is a plan view showing an embodiment of a wound core manufactured according to the present invention.
Figure 4:
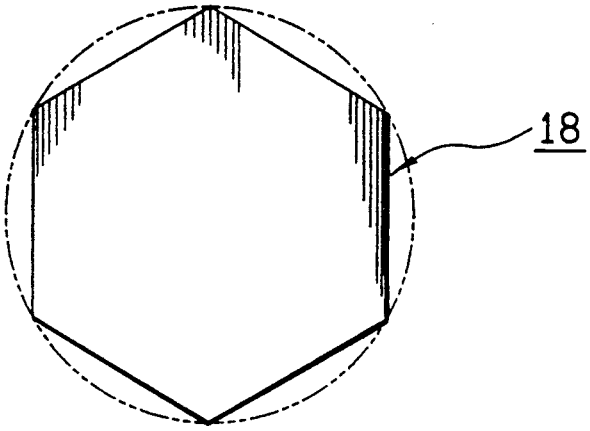
FIG. 4 is a sectional view along line IV—IV of FIG. 3.

Next, the continuous material 13 is wound from the leading end 14 of one winding material 12 to a bobbin (not shown in the Figure), being moved in the width direction with respect to the bobbin so as to maintain the center 17 at a fixed position in the width direction of the material, and is cut out at the trailing end 15 and the winding is finished. During the winding, the moving in the width direction causes deformation to some part of the material, i.e. that by tensile stress around one side edge of the widest position 16 and that by compressive stress around the other side edge. However, the deformation is negligible because the material is extremely long and narrow, and the angle caused by the deformation is also extremly small. Then, as with the conventional wound core, the trailing end 15 is fixed, the bobbin is pulled out, heat processings etc. are applied, and a wound core 18 with equilateral hexagonal cross-section as shown in FIGS. 3 and 4 is completed.

In the cutting out of the above-mentioned magnetic material, a device having the same construction as that of a slitting machine, which is used for manufacturing wound cores with circular cross-section, can be used by simply changing the setting of the cut out curve. In winding, a device having the same construction as that used for manufacturing wound cores with circular cross-section can be used. The fact that the cut out line is a polygonal line can be utilized, as a matter of course, to manufacture a special device of simpler construction for the above processes.

In the above described method, each continuous strip of material 13 can be wound as is, and cut apart into individual strips of winding material 12 after the winding has been completed. Alternatively, it is possible to use a method by which the continuous material 13 is first cut into individual strips winding material 12, and afterward each individual winding material is wound.

A wound core 18 completed in the above manner is fitted with a cylindrical bobbin, as in the case of a conventional wound core with a stepped-circular cross-section, wound with wires and use for a transformer or other devices. The occupation ratio for the cross-section of the magnetic material in the wire is about 83%, which is almost equal to that of the wound core with a five stepped-circular cross-section.

Figure 5:
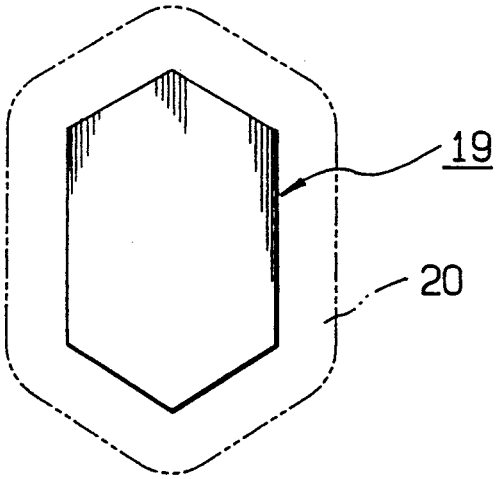
FIG. 5 is a sectional view showing the same portion as shown in FIG. 4 of another embodiment of a wound core manufactured according to the present invention.
Figure 6:
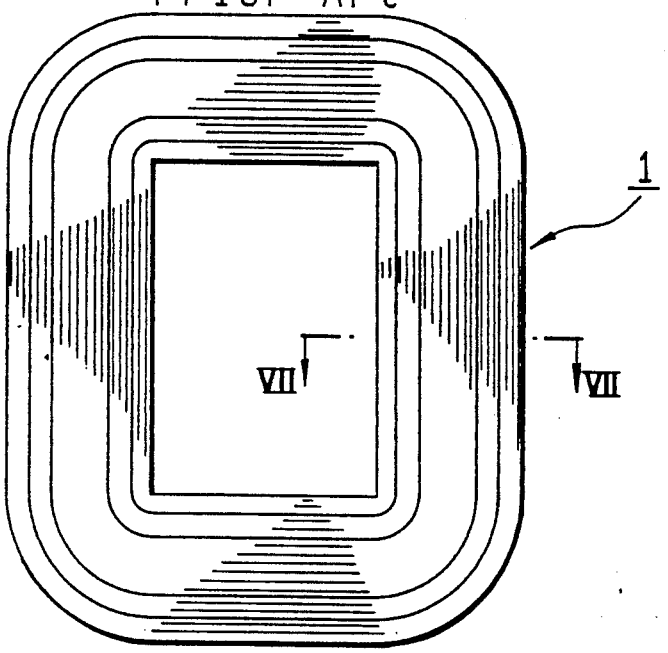
FIG. 6 Prior Art
FIG. 6 is a plan view of a conventional wound core with a stepped-circular cross-section.
Figure 7:
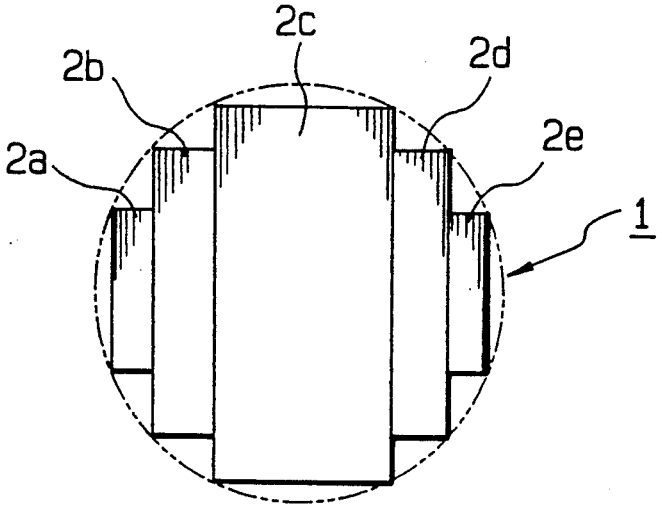
FIG. 7 Prior Art
FIG. 7 is a sectional view along line VII—VII of FIG. 6.
Figure 8:
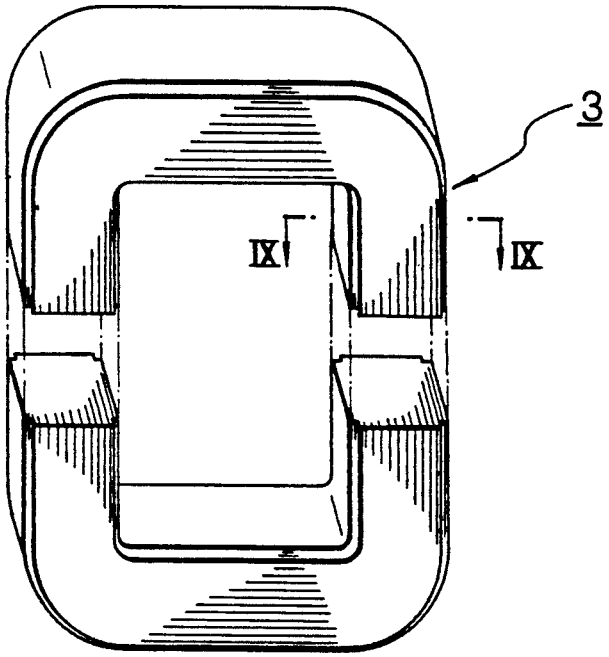
FIG. 8 Prior Art
FIG. 8 is a perspective view of a conventional cut-core.
Figure 9:
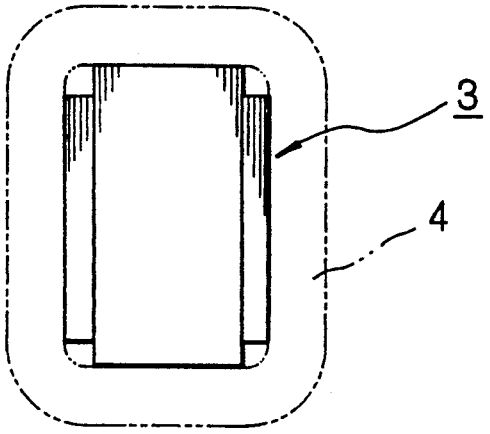
FIG. 9 Prior Art
FIG. 9 is a sectional view along line IX—IX of FIG. 8.

In the above embodiments, a cross-section is formed into an equilateral hexagon, but the present invention can also be used to form the cross-section into an elongated hexagon as the wound core 19 shown in FIG. 5.

The wound core 19 can be applied to a cut-core. Since the corner has an angle of 120 degrees, the bending ratio at the corner portion of the coil wire wound around the core 19 is rather small. Therefore, the wound core 19 can replace the conventional cut-core with steps. Moreover, the wound core 19 can realize a higher occupation ratio of the cross-section than that of the conventional cut-core with steps.

The wound core with an elongated hexagonal cross-section as described above can be used with a coil wound in a circular shape as in the case of the aforementioned wound core with an equilateral hexagonal cross-section. In this case, the occupation ratio of the cross-section is lowered and the vacant space is increased to allow more efficient cooling.

According to the present invention, as described above, one strip of material is cut into two strips along one cutting line and both of the cut strips are used as winding materials. Therefore, there is no waste of material and improved economical efficiency can be achieved. In particular, there are remarkable economic benefits concerning such electric power equipments as distribution transformers which use a large amount of grain-oriented magnetic silicon steel or wound cores which use expensive material such as amorphous magnetic material, nickel-based magnetic material and extremely thin magnetic silicon steel. In addition, the process of scrapping is eliminated because there is no waste of material, so the efficiency of the cutting is improved.

Furthermore, since two strips of material are obtained by cutting only one strip of belt shaped magnetic material production controls such as control of wear of the cutting tool, control of burrs after cutting and control of shapes and dimensions are required with only one of the two strips. Therefore, overall control of operations can be simplified.

The wound core according to the present invention is completed only by winding one material, so the connecting operations, which are required for manufacturing conventional wound cores with steps or with a polygonal cross-section, is not necessary and the production efficiency can be increased. Control of materials is also simplified because only one kind of material is used.

The wound core manufactured according to the present invention offers excellent magnetic characteristics and reduces noise.

The cutting device which is to carry out the present invention can be constructed easily because, as described above, the cutting tool is used only at one location, the cutting line is a simple polygonal line formed simply by connecting two straight lines and the scrapping device is not necessary.

What is claimed is:

1. A method of manufacturing a wound core comprising the steps of:

(a) cutting one belt shaped strip of magnetic material along one polygonal line that extends in a longitudinal direction of said strip so as to form two continuous strips of said material, each said continuous strip consisting of a sequential connection of individual long pentagonal shaped portions wherein the width of each pentagonal shaped portion changes to be narrow at a leading end thereof, and to be wide in a middle part and narrow again at a trailing end; and (b) forming a wound core by continuous winding of one of said pentagonal shaped portions so as to maintain a center line thereof at a fixed position in the width direction of said portion to form a wound core with a hexagonal cross section.

2. The method of manufacturing a wound core as recited in claim 1, wherein said cutting step is performed so that a length of each pentagonal shaped portion from said leading end to said wide portion at the middle part is smaller than that from the wide portion to the trailing end.

3. The method of manufacturing a wound core as recited in claim 1 wherein said forming step is performed under stress so as to cause deformation to said magnetic material to maintain said center line at the fixed position in the width direction of the material.

4. The method of manufacturing a wound core are recited in claim 3 wherein the forming step is performed with a continuous strip of pentagonal shaped portions, and said one of said portions is cut apart after the winding of that portion has been completed.

5. The method of manufacturing a wound core as recited in claim 3, wherein a continuous strip of pentagonal shaped portions is first cut into individual pentagonal shaped strips of magnetic material, and said forming step is performed with an individual strip.

6. The method of manufacturing a wound core as recited in claim 1, wherein said cutting step is performed so as to provide pentagonal shaped portions that form a core with an equilateral hexagonal shaped cross-section.

7. The method of manufacturing a wound core as recited in claim 1, wherein said cutting step is performed so as to provide pentagonal shaped portions that form a core with an elongated hexagonal cross-section.

* * * * *